United States Patent [19]

Block et al.

[11] 4,090,333

[45] May 23, 1978

[54] FLEXIBLE GRINDING WHEEL

[75] Inventors: Aleck Block, Los Angeles; Hiroshi Hasegawa, Whittier, both of Calif.

[73] Assignee: Merit Abrasive Products, Inc., Compton, Calif.

[21] Appl. No.: 781,121

[22] Filed: Mar. 25, 1977

[51] Int. Cl.[2] ..... B24D 13/04

[52] U.S. Cl. ..... 51/336

[58] Field of Search ..... 51/332, 334, 336, 337

[56] References Cited

U.S. PATENT DOCUMENTS

| | | | |
|---|---|---|---|
| 2,678,523 | 5/1954 | Leggett | 51/337 |
| 2,808,689 | 10/1957 | Thomson | 51/337 |
| 3,028,709 | 4/1962 | Hedden | 51/337 |
| 3,144,738 | 8/1964 | Block | 51/336 |
| 3,600,861 | 8/1971 | Haywood | 51/337 |
| 3,795,498 | 3/1974 | Hasegawa | 51/334 |

*Primary Examiner*—Harold D. Whitehead
*Assistant Examiner*—Nicholas P. Godici
*Attorney, Agent, or Firm*—Charles H. Schwartz

[57] ABSTRACT

A flexible grinding wheel, including, a core member having a central opening and a flange portion at one end, a shaft member disposed within the central opening and extending from the core member for supporting the core member for rotation, a plurality of leaves of abrasive material extending radially outward and disposed circumferentially around the core member and with the plurality of leaves at one end disposed against the flange, and bonding material disposed to bond the leaves to the core member including the flange portion and with the bonding material disposed between the leaves and extending partially outward along the length of the leaves from the core.

11 Claims, 6 Drawing Figures

FIG. 1
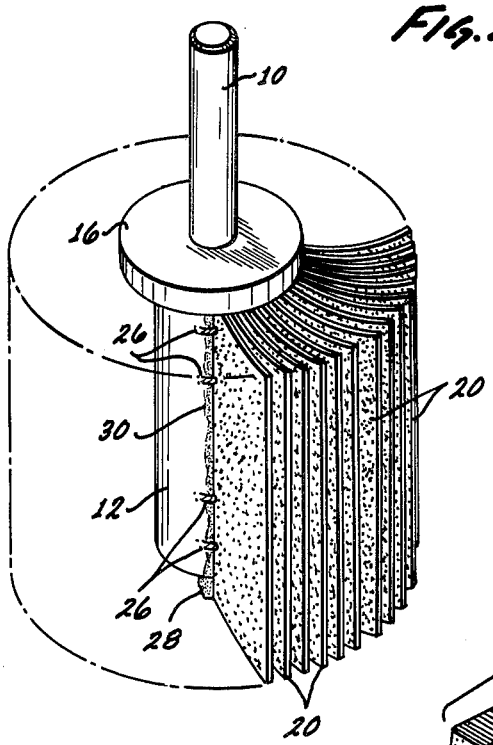
FIG. 3
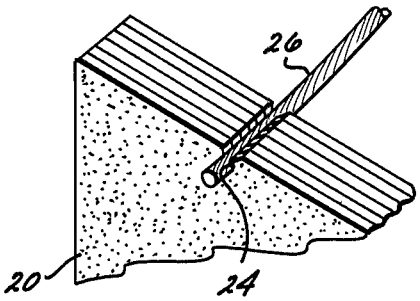
FIG. 2
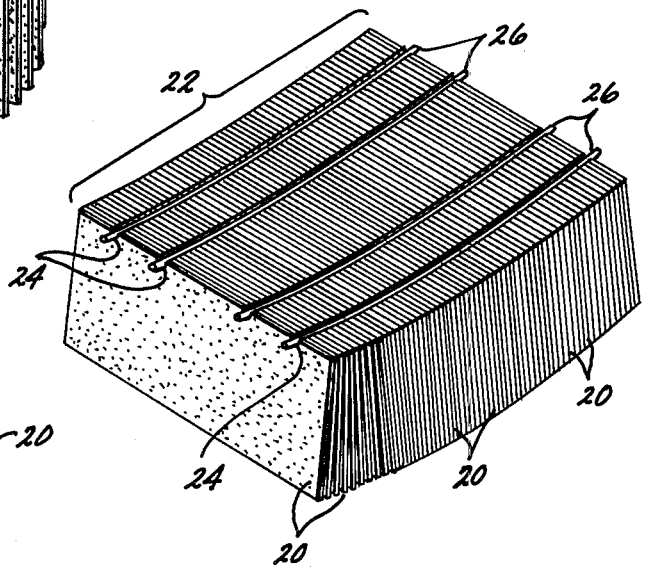
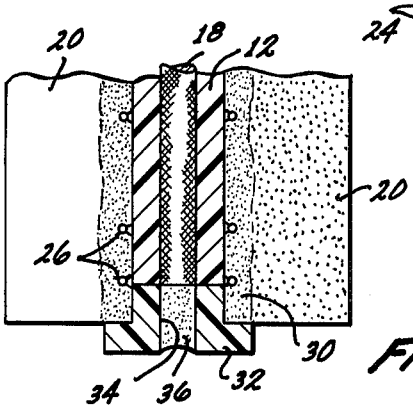
FIG. 6
FIG. 4
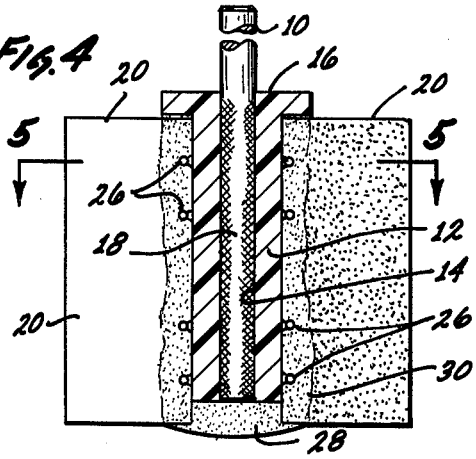
FIG. 5
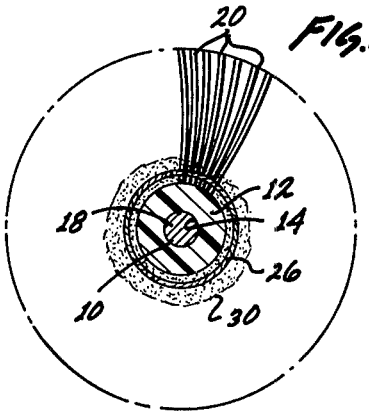

FLEXIBLE GRINDING WHEEL

The present invention is directed to a flexible grinding wheel constructed of a plurality of leaves of abrasive material extending radially from and disposed around a core and including a shaft for use in providing a rotational movement of the grinding wheel.

The present invention is directed to an improved flexible grinding wheel which is simple in construction and fabrication to allow for a reduction in the cost of manufacture of the grinding wheel. Notwithstanding the simplicity of construction and fabrication of the flexible grinding wheel of the present invention, the resultant structure is well balanced in operation and has the leaves of abrasive material securely bonded into position to ensure a long life for the grinding wheel.

In the particular construction of the flexible grinding wheel of the present invention, the abrasive leaves are initially formed as a rectangular block of leaves positioned adjacent each other. One edge portion across all of the leaves includes at least one groove and with a cord placed within the groove to hold the leaves together in the block. A plurality of grooves may be distributed along the edge portion and with a complementary number of cords securely holding the block of leaves together.

A metallic shaft is scored and then pushed to fit into a core of plastic material. The core may be a premolded piece and has a flanged portion to retain the leaves in position when the rectangular block of leaves is folded into a circular shape around the core. The rectangular block is folded so that the leaves are radially disposed outwardly and with each leaf extending from the core.

Normally the core does not extend completely along the width of the leaves so that a small opening is provided at the end of the leaves opposite the flanged portion. This opening may be used to insert a liquid plastic material such as an epoxy to flow down the inside of the leaves between the leaves and the core and flow outward along the length of the leaves and may also flow between the shaft and the core to provide for a binding of all of the elements of the grinding wheel together. An excess of epoxy may be used to form a plug to close the open end and to retain the leaves in position. As an alternative, a separate plug member may be inserted to close the open end. The plug member may include a central opening and with the plug member inserted in position and then the epoxy material flowed into the interior of the grinding wheel through the opening.

The flexible grinding wheel of the present invention is very simple in construction since the abrasive leaves are first formed as a rectangular block of individual leaves and the block is then folded around the core. All of the elements of the grinding wheel are then bound together by the use of an epoxy which flows through the interior portion of the core and the leaves and then sets up to form an integral wheel structure.

A clearer understanding of the invention may be had with reference to the following description and drawings wherein FIG. 1 illustrates a perspective view of a flexible grinding wheel constructed in accordance with the teachings of the present invention;

FIG. 2 illustrates the abrasive leaves maintained in a rectangular block form;

FIG. 3 is a detailed view of FIG. 2 illustrating cords positioned in grooves at the edge of the abrasive leaves for maintaining the leaves in position;

FIG. 4 is a cross-sectional view of a first embodiment of the invention showing the end filled with epoxy material;

FIG. 5 is a top view showing the flowing of the epoxy material between the leaves; and FIG. 6 is an alternative embodiment of the invention wherein the open end is plugged with a plug member.

In FIG. 1 a perspective view of a flexible grinding wheel constructed in accordance with the teachings of the present invention is shown. The grinding wheel includes a metallic shaft 10 for use in supporting and rotating the grinding wheel during use. Normally, the shaft 10 would be inserted into a chuck and motor driven to provide rotation of the grinding wheel. The shaft 10 is also shown in FIG. 4 to extend into a core member 12. The core member 12 may be premolded to the desired shape to have an opening 14 to receive the shaft 10 and a flanged portion 16. The core may be constructed from a thermoset material such as a phenolic or epoxy to serve as a support for the leaves of grinding material and to receive the shaft 10. The shaft 10 may be pushed into the opening 14 and the shaft 10 may include a roughened surface such as shown by cross-hatching 18 to ensure a tight fit within the core 12.

Positioned radially around the core 12 are a plurality of leaves 20 of abrasive material which leaves are normally formed from sheet material such as cloth and have one side covered with an abrasive compound and the other side smooth. Various types of sheet abrasive material may be used and the specific type that is used is not a part of the present invention and it is to be appreciated that the type chosen is in accordance with the desired degree and smoothness of grinding desired.

As shown in FIG. 2, the leaves of abrasive material 20 are initially formed as a rectangular block of individual leaves 22. Along the top edge of each one of the leaves in the block and extending across the block, a plurality of grooves 24 are provided and, as shown in FIG. 2, four (4) such grooves may be provided. Cord members 26 may be disposed in the grooves 24 so as to hold the various leaves 20 together to form the block shown in FIG. 2. In addition, the use of the cords 26 positioned in the grooves 24 allow for the leaves in the block 22 to be folded around a circular member such as the core 12 to provide for the leaves 20 extending radially outward as shown in FIGS. 1 and 5.

During the construction of the flexible grinding wheel of the present invention, the core member 12 may be molded to the desired configuration and the shaft 10 inserted into position within the opening 14 in the core member. The leaves of abrasive material 20 may be precut into the desired size and with the grooves 24 formed along one adjacent edge of all of the leaves. The cords 26 may be placed in the grooves 24 to extend between adjacent leaves 20 so as to form the rectangular block of leaves of abrasive material 20 as shown in FIG. 2. The individual leaves 20 in the block 22 may then be folded around the core 12 so that the individual leaves extend radially outward. It is to be appreciated that a jig or a tool may be used so as to maintain the various parts in the proper relationship.

Once the individual leaves 20 in the block 22 are folded around the core, then the various elements are ready to be bound together to form the grinding wheel. This binding is accomplished through the use of a thermosetting material such as an epoxy inserted into the open end opposite the flange member 16. Specifically, epoxy material 28 may be poured into the open end to flow down the core 12 between the core and the leaves 20 and to flow partially outward between the leaves along the length of the leaves as shown by reference numeral 30 to bind the leaves together and bind the leaves 20 to the core 12. In addition, the epoxy material may run down the opening 14 within the crosshatched portions 18 of the shaft 10 to further bind the shaft 10 within the core 12. Also, it is to be appreciated that the epoxy material will run into the grooves 24 to bind the cords 26 within the leaves 20 to further provide for a bonding of the leaves together and to provide bonding of the leaves 20 to the core 12. In addition, the epoxy will flow between the flange 28 and the leaves 20. The epoxy material 28 as shown in FIG. 4 also forms a plug 28 so that the leaves are also locked between the plug 28 and the flange 16.

In another embodiment of the invention as shown in FIG. 6, a separate plug member 32 having a flanged portion may be inserted in the open end and the plug member 32 may have an opening 34. Epoxy material 36 may be poured through the opening 34 to run down the core and in between the leaves as shown by reference numeral 30 in the same manner as for the embodiment of the invention shown in FIG. 4. As an alternative, the epoxy material may be initially poured in the open end and with the plug 32 then inserted after the epoxy material has been poured. In the embodiment of FIG. 6, the leaves would be locked in position in a similar manner as described above and, in addition, the flange portion of the plug 32 would cooperate with the flange portion 16 shown in FIG. 4 to again lock the leaves in position.

In the particular structure of the present invention, the final product will be balanced in operation since all of the elements are built up around a central core member. In addition, the bonding occurs from an inside position to bind the leaves and the core together with the bonding material. A control of the amount of bonding material that is inserted also controls the amount of bonding material that flows between the leaves as shown in position 30. This control of the bonding material provides that the bonding material is equally distributed which provides for a balanced operation of the grinding wheel.

It can be seen, therefore, that the present invention provides for a flexible grinding wheel which is simple in construction and simple in fabrication and yet provides for a balanced structure. The grinding wheel is strong and will have a long life and is relatively low in cost since the construction and manufacture has been greatly simplified.

Although the invention has been described with reference to particular embodiments, it is to be appreciated that various adaptations and modifications may be made and the invention is only to be limited by the appended claims.

We claim:

1. A flexible grinding wheel, including, a core member having a central opening and a flange portion at one end, a shaft member disposed within the central opening and extending from the core member for supporting the core member for rotation, a plurality of leaves of abrasive material extending radially outward and disposed circumferentially around the core member and with the plurality of leaves at one end disposed against the flange, and bonding material disposed to bond the leaves to the core member including the flange portion and with the bonding material disposed between the leaves and extending partially outward along the length of the leaves from the core, and wherein the bonding material forms a flange disposed against the leaves at the other end opposite the flange portion of the core member.

2. The flexible grinding wheel of claim 1 wherein the bonding material is an epoxy material flowed down the core and between the leaves adjacent the core.

3. The flexible grinding wheel of claim 1, wherein the leaves include at least one groove across the adjacent edges of the leaves disposed against the core member and additionally including at least one cord disposed within the groove to hold the leaves in position prior to bonding the leaves to the core.

4. The flexible grinding wheel of claim 3 including a plurality of grooves and complementary cords holding the leaves in position.

5. The flexible grinding wheel of claim 3 wherein the bonding material bonds the cord within the groove.

6. A flexible grinding wheel, including, a core member having a central opening and a flange portion at one end, a shaft member disposed within the central opening and extending from the core member for supporting the core member for rotation, a plurality of leaves of abrasive material extending radially outward and disposed circumferentially around the core member and with the plurality of leaves at one end disposed against the flange, bonding material disposed to bond the leaves to the core member including the flange portion and with the bonding material disposed between the leaves and extending partially outward along the length of the leaves from the core, and a plug member having a flange portion disposed against the leaves at the other end opposite the flange portion of the core member and with the bonding material additionally bonding the plug member to the core member and the leaves.

7. The flexible grinding wheel of claim 6 wherein the bonding material is an epoxy material flowed down the core and between the leaves adjacent the core.

8. The flexible grinding wheel of claim 6 wherein the plug member has a central opening and with the epoxy material disposed within the opening.

9. The flexible grinding wheel of claim 6 wherein the leaves include at least one groove across the adjacent edges of the leaves disposed against the core member and additionally including at least one cord disposed within the groove to hold the leaves in position prior to bonding the leaves to the core.

10. The flexible grinding wheel of claim 9 including a plurality of grooves and complementary cords holding the leaves in position.

11. The flexible grinding wheel of claim 9 wherein the bonding material bonds the core within the groove.

* * * * *